US006280309B1

(12) United States Patent
Van Osenbruggen

(10) Patent No.: US 6,280,309 B1
(45) Date of Patent: Aug. 28, 2001

(54) ACCESSORIES AND ATTACHMENTS FOR ANGLE GRINDER

(75) Inventor: Anthony Alfred Van Osenbruggen, Kelston (NZ)

(73) Assignee: Norton Company, Worchester, MA (US)

( * ) Notice: Subject to any disclaimer, the term of this patent is extended or adjusted under 35 U.S.C. 154(b) by 0 days.

(21) Appl. No.: 09/068,919

(22) PCT Filed: Oct. 16, 1996

(86) PCT No.: PCT/US96/16501

§ 371 Date: May 20, 1998

§ 102(e) Date: May 20, 1998

(87) PCT Pub. No.: WO97/14537

PCT Pub. Date: Apr. 24, 1997

(30) Foreign Application Priority Data

Oct. 19, 1995 (NZ) ..... 280292

(51) Int. Cl.[7] ..... B24B 19/00

(52) U.S. Cl. ..... 451/415; 451/426; 451/550; 451/359; 451/549

(58) Field of Search ..... 451/415, 426, 451/442, 548, 550, 354, 353, 359, 545, 549

(56) References Cited

U.S. PATENT DOCUMENTS

| | | | | |
|---|---|---|---|---|
| 2,954,653 | * | 10/1960 | Harvey | 451/456 |
| 3,875,703 | * | 4/1975 | Clemente | 451/415 |
| 4,844,967 | * | 7/1989 | Goralski et al. | 451/359 |
| 4,951,423 | * | 8/1990 | Johnson | 451/358 |
| 5,201,785 | * | 4/1993 | Nagano | 451/501 |
| 5,394,652 | * | 3/1995 | Casillas et al. | 451/241 |
| 5,466,183 | * | 11/1995 | Kirn et al. | 451/359 |

* cited by examiner

*Primary Examiner*—Joseph J. Hail, III
*Assistant Examiner*—Lee Wilson
(74) *Attorney, Agent, or Firm*—David Bennett

(57) ABSTRACT

Accessories for an angle grinder include a tool comprising a rotary disk having releasably attached to its surface, an annular attachment having a cutting or abrading, ("shaping"), surface, and rest means in a rest zone for supporting the grinder on a surface to be shaped. The rest means may be a non-rotating nose beneath the grinder; a rubbing contact mounted on a flat tool or simply part of the surface of a convex tool. Tilting the grinder about the rest means gives effective control of the tool. Steeper tilts cause the cutting or abrading surface to bite more deeply into the surface to be shaped. The grinder is preferably stroked toward the user with the cutting or abrading zone trailing. Most disks are perforated. Work to be shaped can be seen through the spinning disk during use. The annular attachment can have a variety of cutting or abrading surfaces.

22 Claims, 8 Drawing Sheets

ACCESSORIES AND ATTACHMENTS FOR ANGLE GRINDER

TECHNICAL FIELD OF THE INVENTION

Figure 1A:
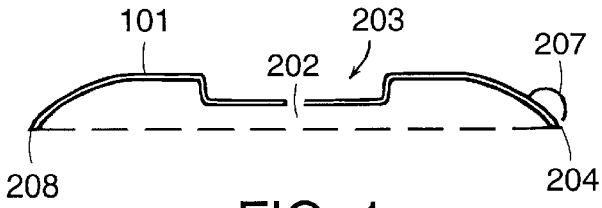

This invention relates to the field of disc-shaped cutting or abrading, rotating tools of the type having manufactured cutting or abrading surfaces, which tools may be used for shaping and forming materials, and in particular this invention relates to accessories for angle grinders which are adapted for use with a hand-held angle grinder and to cutting or abrading attachments for such a grinder.

BACKGROUND

A number of applications in the construction or repair of solid articles involve the selective removal of material from a bulk in order to produce a desired conformation or shape. For example a builder may remove some wood from a beam in order to produce a neat fit—more likely if the house being built is non-rectangular; a foundry removes surplus metal from sprues or joints between mould parts when producing a casting; a wood carver selectively removes wood in order to produce a carving a panel beater frequently removes surplus plastic filler which was placed within a defect in an automotive panel to build it tip, so that the outline conforms with the original outline of the panel; or a boat builder may have to remove kilograms of material, such as lead-filled fibreglass when shaping or repairing a hull.

In a previous Application published as WO 95/29788 on Nov. 9, 1995, Applicant described an invention in which a first aspect comprised an accessory for a grinder including a rotatable tool having a shape substantially that of a disk, having an axis of rotation and capable of being mounted on an arbor of an angle grinder, characterised in that the rotatable tool is provided with a working zone extending inwardly from the perimeter of the tool; and rest means extending substantially inwardly from the working zone of the tool, which rest means is displaced from the working zone along the line of the axis of rotation.

For clarity it should be understood that the term "working zone" refers to the permitted location on the tool where cutting or abrading means might be located. The "working surface" of the tool refers to those parts of the working zone where cutting or abrading means are actually located.

In a preferred aspect of the previous Aplication the rest means is concentric with and supported on the rotatable tool, and most preferably comprises a portion of a convex surface In an alternative embodiment the previous Application comprises an accessory for a grinder characterised in that the rest means comprises a fixed rubbing surface or nose supported on the angle grinder and displaced so as to be supported beyond the rotatable tool. (By "beyond" we mean beyond the end of the arbor, or below the tool as it is normally held).

In a further preferred aspect the previous Application comprises a rotatable disk-shaped accessory for a grinder having a working zone and a rest means, characterised in that the working zone extends inwardly over the surface of the disk from the perimeter over from about a first third to about two thirds of the radius.

Other preferred featured of the previous Application include providing that: the working surface of the rotatable tool with at least one cutting tooth; each cutting tooth has at least one cutting edge lying in a plane substantially coplanar with the radially adjacent surface of the tool; and each cutting tooth projects from the radially adjacent surface of the tool by a height of up to 3 percent of the diameter, so that the depth of cut of each tooth is limited. Each cutting tooth can be additionally provided with a tooth rubbing surface or gauge surface; the rubbing surface projecting outwardly at least as far as the cutting zone of the tooth, thereby limiting the depth of cut of each tooth.

The accessories of the present invention are distinguished from those described in UK Patent Application 2 207 626 which teaches a metallic abrading disk with a recessed central portion and U.S. Pat. No. 4,835,912 which provides a species of flap disk with a rotatable central disk and, attached around and projecting beyond the periphery thereof, a plurality of sandpaper loops providing the abrasive element of the tool.

STATEMENT OF THE INVENTION

The present invention provides a further extension of the general concepts embodied in the previous Application described above. In one aspect the invention comprises an accessory for a grinder comprising a rotatable disk-shaped tool having a rest zone and a working zone said working zone being located at the outer perimeter of the disk and being adapted to releasably receive and retain an annular attachment having an attachment surface and a working surface provided with shaping means. Preferably the accessory has the main characteristics of the invention described in the previous Application with the difference that the working surface is provided by the annular attachment adapted to be releasably attached to the tool in the region of its working zone adjacent the outer perimeter rather than by the disk surface itself.

The attachment means by which the annular attachment may be attached to the disk-shaped tool can be any convenient means. These may include for example a stud and slot arrangement in which a series of studs formed on the back surface of the attachment, (that is the surface not bearing cutting or abrading means), and having enlarged heads are fitted into cooperating arcuate slots in the surface of the rotatable disk having enlargements at one end that are just sufficient to accomodate the enlarged heads of the studs. Rotation of the annular attachment in the direction of rotation of the disk when in use then moves the studs within the slots such that the heads are located at the non-enlarged ends of the slots and are not disengageable from the slots without reversing the rotation. Alternatively the attachment can be secured using projecting tabs adapted to fit into cooperating slots in the disk and be bent around to engage the disk and prevent diengagement until the tabs are straightened. Other similar attachment devices include spring fit attachments anchored around the edge of the disk, circlips and other similar mechanical devices that will be readily be devised by the man of ordinary skill in the art. Several examples are illustrated in FIGS. 27 and 28.

The shaping means are located on the opposed surface of the disk to the attachment means and generally comprise cutting or abrading means. The cutting means are generally cutting edges (teeth), and the abrading means is understood to include means capable of removing material from the surface by an action that does not involve removal using a cuttin action. This would include surfaces comprising a layer of abrasive grit, hardened stubby projections, knurled or ridged surfaces, bristles and the like.

Consistent with the provision of the working surface in the form of the surface of an annular attachment to the rotatable disk-shaped tool rather than on the tool itself, the preferred features and aspects of the previous invention referred to above are also preferred features of the present invention.

Shape of the Annular Attachment

The invention also provides an annular shaping attachment for a rotatable disk-shaped tool having at least one set of coupling means adapted for reversibly attaching the annular attachment to the rotary tool. The preferred annular attachment comprises a working surface and an attachment surface with the working surface having shaping means located thereon and the attachment surface comprising means by which the annular attachment can be releasably attached to a substrate, particularly one in the form of a disk-shaped rotatable tool.

In a preferred form the annular attachment has the shape of a truncated cone in which the interior surface carries the attachment means and conforms to the curvature of the surface of the outer peripheral portion of a convex disk-shaped tool to which it is intended to be affixed. Thus the plane of the inner edge of the annular attachment is preferably displaced from the plane of the outer edge of the attachment along the axis of the tool and away from the grinder when the tool is attached and ready for use.

The annular attachment is of a size suitable for location on the outer periphery of a tool to which it is intended to be attached and to extend radially inwardly from the edge of the disk-shaped tool by up to two thirds, and more preferably up to one third, of the radius of the disk.

Most preferably the annular attachment is adapted to fit in a cooperating recess located around the perimeter of the surface of the disk-shaped tool such that the inner edge of the attachment is in contact with a shoulder formed between the centrally located portion of the body of the disk-shaped tool and the recessed area on the perimeter of the tool.

Surface of the Annular Attachment

One embodiment of the invention comprises a rotatable disk-shaped tool or accessory for a grinder having a working surface and a rest means characterised in that the working surface of the tool is provided by an annular attachment for the disk which provides a working surface comprising at least one sector bearing a series of stubby hardened projections on the working surface of the annular attachment; and a rubbing surface adjoining each such sector and extending in the plane of the working surface of the annular attachment from each such sector. The term "hard" or "hardened" as used herein is intended to indicate that the material that is "hard" or "hardened" is harder than the material to which it is attached. Thus the "hardened projections" is understood to refer to structures formed on the surface from a material that is harder than the material of the surface itself. By "stubby" projections we mean tetrahedral or similar shaped projections, preferably having distinct corners though preferably not having knife edges.

In a further preferred embodiment the shaping means on the working surface of the annular attachment comprises an abrasive area comprising a matrix incorporating a hard granular abrasive material coated on to at least a portion of one side and/or the edge of the rotatable tool.

In a related aspect the invention comprises a rotatable tool for a hand-held grinder system as described previously, having a shaping surface provided by an annular attachment for the tool said attachment having a sectored, ribbed or knurled surface (including a surface bearing stubby projections) of a hard material on at least one portion of the surface of the annular attachment and a rubbing surface between the sectors. Most preferably there are between three and twelve symmetrically located sectors of a hard material with interspersed rubbing surfaces. A "rubbing surface" is understood to be a surface that contacts the workpiece without substantially abrading or cutting it. The rubbing surface is preferred feature since it provides a cooling interval between shaping (that is, abrading or cutting), episodes during rotation of the tool. It can also act, where the surface is cut by teeth inset into the surface of the annular attachment, as a device to limit the extent to which the teeth are able to cut into the workpiece and thereby promotes even and controlled shaping.

In another preferred embodiment of the invention the working zone of the annular attachment has an abrasive surface provided by affixing an abrasive matrix incorporating a hard granular material on to at least portions of one side and the edge of the annular attachment.

In an alternative format, the annular attachment bears a number of wire bristles of a length such that, when a grinder having a tool according to the invention fixed thereto is placed on the surface of a workpiece with the rest means in contact therewith and with the axis of rotation of the rotatable tool at right angles to the surface of the workpiece, the bristles do not contact the workpiece. The wire bristles may be made of any convenient material such as steel or brass or some other suitably stiff and abrasive material. The bristles are typically in the form of tufts though this not essential. The tufts can be clustered in groups spaced around the annular attachment or they can be located all around the annular attachment in an uninterrupted ring.

In a related aspect the invention comprises an annular attachment for a rotatable cutting tool as described previously, said attachment bearing cutting teeth, in which the teeth are created by a shaping treatment followed by a chemical or heat hardening process applied to at least the teeth formed on the annular attachment. More preferably however the teeth are manufactured from a separate, hard material and then fixed to the surface of the annular attachment. The teeth provide cutting edges at or close to the outer periphery of the annular attachment, and rubbing surfaces are preferably located adjacent the teeth. The cutting edges preferably protrude beyond the rubbing surfaces by less than 2 mm for a 120 mm disk diameter. Most preferably the teeth are provided at three places about the disk and rubbing surfaces are located between the three locations. Optionally the teeth in each location can be in groups of two or three. Preferably the total number of cutting teeth is between one and twenty four. More preferably there are three cutting teeth or groups of cutting teeth provided, symmetrically spaced, on the surface of the annular attachment.

As indicated above each tooth is preferably also provided with adjacent gauging means in the form of rubbing surfaces. Preferably the rubbing surfaces comprise the material of the annular attachment itself, at about the same distance from the centre as the actual teeth. Optionally the rubbing surfaces may comprise adjacent teeth, or inserts of a hard material. The gauging means can therefore be a portion of the tooth provided with an edge having a negative cutting angle, or may be an adjacent raised portion on the outer surface, ("rubbing surface"), of the annular attachment. Optionally the actual angles may be varied according to the type of material on which the cutter is to be used. Alternatively the gauging means may be a raised portion of the perimeter of an aperture through the tool.

Preferably the teeth are formed from hard material each provided with a cutting edge having a positive angle with respect to the direction of rotation. Also preferably the hard material is tungsten carbide.

Method of Use

In a further aspect the invention comprises a hand-held grinder system for use in shaping a surface of a workpiece, including a rotatable disk-shaped shaping, (that is, cutting or abrading), tool mounted on a rotatable spindle, said rotatable cutting tool having an active working zone adapted for removing material from the surface, and rest means (or rest zone), which rest means, in use, permits control of the shaping action of the grinder system if the grinder system is first rested with substantially only the rest means contacting the workpiece surface and then the grinder system is tilted more towards the active contact zone in order to cause or increase engagement of the active contact zone with the workpiece surface and in which the working zone is provided by an annular attachment releasably attached to the outer periphery of the rotatable disk.

In a still further aspect the invention comprises a method for shaping material, comprising the steps of (a) causing a tool having an annular attachment providing the working surface according to the above description to be affixed to an angle grinder or the like, (b) applying power to the angle grinder motor, (c) holding the disk against the work while tilted at a low angle to it (so that the working surface is not engaged) and raising the tilt to a higher angle so that the working surface is engaged to a suitable depth, and (d) drawing the cutting disk towards the user meanwhile having the opportunity to view the work through apertures in the rotating disk.

Additional Features

In a related aspect the invention comprises an accessory for a grinder comprising a rotatable disk-shaped tool characterised in that at least one viewing aperture is provided through the disk of the rotatable tool. The viewing aperture (s), when the tool is rotating, preferably also serve to cause air movement.

In a related aspect the invention comprises a hand-held grinder system as described previously, wherein the rest means provided with rotational bearing means so that in use the separate rest means may rotate independently of the rotatable cutting tool.

In a related aspect the invention comprises an rotatable disk-shaped tool for a grinder characterised in that the disk is provided with a central recessed mounting aperture of the disk and surrounding the aperture is a gripping means or clutch means capable of disengagement when a torque applied between the rotatable spindle and the cutting tool exceeds a predetermined amount.

Preferably the rotatable cutting tool has a central mounting aperture adapted for attachment to a rotatable spindle of a grinder and the central recessed mounting aperture is provided with clutch means capable of disengagement while a torque applied between the rotatable spindle and the cutting tool exceeds a predetermined amount. Also preferably the central recessed mounting aperture is provided with resilient mounting means capable of reducing vibration caused by eccentricity. Thus the preferred rotatable disc-shaped tools are provided with a central recessed mounting aperture having resilient mounting means capable of reducing vibration.

Preferably the means for attachment of the disk comprises a shaped depression, shaped to match the profile of an arbor and nut. Preferably the nut includes means to impose a grip on this disk using static friction, and preferably the static friction is overcome at a torque less than that which can damage a means for driving the rotary shaft. Preferably the disk is adapted for use with an ordinary angle grinder. Optionally it may be adapted for use with other rotatable powered machines. Optionally the angle grinder may be fitted with a guard, in order to control swarf.

Preferably the disk is adapted for mounting upon the spindle or arbor of an angle grinder tool and for this purpose the disk is provided with an optionally threaded central mounting aperture. Optionally the border of the central aperture is depressed towards the inner surface of the disk. Preferably the disk is made of mild steel although alternatively it may be made from a hardenable metal or alloy or from a plastics material. Optionally the disk may be made by other processes, including pressure die-casting. Preferably a mild steel disk is 2 to 6 mm thick. Optionally the disk may be flat and in this case there may be two functional outer surfaces having cutting teeth, although only one can be used at one time. Preferably the disk is deformed into a conical or curved profile and preferably the outer cutting surface is convex.

Theory and Principles

The invention provides a hand-held grinder system; as practically all of these are for the type of machine known as an angle grinder we shall predominantly refer to angle grinders.

We have provided the grinding machine with a rest point—comprising rest means allowing the operator to lean or rest the tool on the work surface, while in use, and from that leaning or rest point, to gradually slope or incline the machine until the cutting face or edge of its disk starts cutting or abrading the work surface. From this time the machine may be slid or "stroked" preferably towards the operator; meanwhile the surface to be treated becomes visible through holes in the spinning disk prior to cutting. We call the invention a "system" because we can provide the rest point on the body of the angle grinder; most conveniently as part of a guard beneath a portion of the wheel (FIG. 21 ) or, often more preferably, we can provide the rest point on the spinning disk, where it may form:

(a) A more central part of the disk—where a domed or convex disk is used, (b) An attached protrusion such as a domed washer, spinning with the disk. Here the disk itself may be flat though still providing a working surface at one side of its perimeter) or (c) An attached though separately rotatable protrusion, such as a domed washer mounted by means of a bearing onto the disk or grinder spindle. This is commonly termed a "dead" guide.

Intimately associated with this method-based concept is the provision of a range of tools with novel cutting or abrading surfaces located on an annular attachment having an active, or working, zone area potentially comprising the entire surface of the annular attachment which preferably extends inwards from the periphery of the disk-shaped tool by up to two thirds but more preferably by up to one third of the radius. This working zone can comprise a number of spaced isolated working surfaces in the form of abrasive or cutting sites within the working zone or the whole zone may be provided with such cutting or abrading sites. In addition a rest means located radially inwardly of the working zone.

Because the invention is a disk rotated at a high speed it acquires a considerable angular momentum which helps provide a steady rate of cut. In one preferred form, the tool is adapted to be used with a conventional angle grinder of the widely used type having a typical no-load rotation speed of 11,000 rpm, driven usually by a universal (AC/DC) brush motor. Conventional angle grinders provide a drive shaft onto which various discs (normally of abrasive material) may be mounted and spun at a high speed. A typical angle grinder is the single-speed 115 mm grinder sold as the "AEG WSL115"™ (600 watts). This size of motor provides an acceptable power for the prototype disks. A variable-speed angle grinder may be an advantage.

In use, the work-material and the working surface of the disk are brought together so that the work-material approaches the working zone from the centre of the disk—and the trailing edge of the working zone is the disk edge. The work at or close to the site of the cutting or abrading is preferably at least partially visible through holes cut through the disk.

Teeth

A particularly preferred tool comprises a disk with an annular attachment having located thereon a relatively small number (typically 3–5) of cutting edges, or teeth, each in close dimensional relationship to a rubbing surface or gauge plate located at about the same radius. The teeth have a limited effective protrusion of usually under 1 mm, though up to 2 mm is feasible for a disk of about 125 mm diameter. In general, angle grinder disks range from 100 mm to 200 mm diameter, depending on the capacity of the motor to power a disk and the size of any guard fixed to the gringer. The cutting edges are close to the rim of the annular attachment to the disk. Preferred cutting edges are made from tungsten carbide inserts which are brazed into place and then ground to final shape.

The cutting edge, or toothed, version of the tool of the invention may be thought of as resembling a carpenter's hand plane in its mode of action, although its shape and the disposition of the cutting edges are altered to become suitable for use as an angle grinder tool. We compare the tool to a plane, rather than a saw or a chisel or an abrasive material because (a) the cutting mode is a shearing or scraping action, (b) we use artificially formed hard teeth, (c) the teeth are mounted in relation to a rubbing surface so that the maximum depth of cut is preset. An abrasive has naturally formed teeth—made from the material of the abrasive, and a smooth finish can only be obtained by using such small particles that the scratch made by each one is infinitesimal in relation to the overall work-surface roughness. The rubbing or reference surface used to limit the depth of cut made by a chisel is a part of the annular attachment. The invention resembles a chisel in one way, because the depth of cut can be varied by tilting the tool against the work, but the maximum depth of cut is preset to perhaps 20–40 thousandths of an inch (0.51–1.02 mm) per tooth. The tool differs in purpose from an electric plane in that it is designed for making freehand curved shapes rather than accurately flat surfaces. The embodiment of the invention in which cutting edges or teeth are affixed to the annular attachment preferably uses three groups of teeth 102 in the form of tungsten carbide inserts, preferably brazed (or otherwise affixed) about the perimeter of the annular attachment and extending inward from the perimeter. We have found that attachments with three teeth operate more smoothly than thise with four. There is surprisingly little reaction or "kick-back" which makes these tools much safer to use and much easier to use and control. As one increases the tooth number much beyond the next odd number, 5, the power required from the angle grinder increases so much that a suitably powerful motor tends to become heavy to hold and hard to move freely.

It is also possible to form teeth from (a) the annular attachment material itself, preferably locally hardened, or (b) of or including other hard materials, such as certain ceramics, diamond, perhaps as an applied film, or borazon (boron trinitride), tungsten alloys, cobalt, cobalt alloys, chromium, chromium alloys, steel, steel alloys, ceramics, carborundum, diamond-impregnated materials, and the like.

Tooth Edge Profile and Orientation

A cutting disk can be made which comprises an annular attachment with, affixed thereto, flat teeth for an optimised planing action. The direction of the length of the tooth edge should preferably not be along a radius to avoid problems of "chatter" when in use. The outermost portion of the edge is leading during rotation; as a result, there is a tangential scraping action.

The angle made by a section through the tooth perpendicular to the work surface in the direction of rotation is typically less than 90 degrees, so avoiding a "biting in" effect which could pull the insert out of the blade. Details are given later.

In some cases we provide the portion of the cutting tooth trailing the actual edge with a raised profile acting as a gauge so that there is a further limit to tooth protrusion.

Where the tool is adapted to work with brittle hard material such as concrete or masonry the preferred tooth design includes angular projections embedded firmly in the surface of the annular attachment. The preferred projections are trapezoidal inset of a relatively hard tungsten carbide. They may be placed in linear arrays or in groups. One advantage of this version of the invention is that the teeth are securely embedded. This type of tool is expected to produce dust, and any holes that may be provided in the disk are primarily for viewing purposes, and for blowing dust away. Advantages of this type of cutter include that it can freely shape masonry or the like, and other materials such as embedded reinforcing iron are also dealt with without requiring that the tool be changed and without inevitable damage to the tool.

Disk-Shaped Tool

We prefer to provide a dished disk so that we can place the annular attachment with the working surface on the outside or convex side of the disk near its rim, and so allow the user to vary the depth of cut by tilting the disk. Disks can be curved in profile, or include a conic section, or in some cases may be flat. At the disk centre we prefer to provide a profile that mates with an arbor though optionally each cutter may include a thread for direct mounting, perhaps with a spacing washer. Often a preferred disk has a recessed portion within which the annular attachment is located when in position on the tool.

We have made prototype tools from mild steel sheet, from 3 to 6 mm in thickness, and from stainless steel, though other materials can be used. The overall diameter is set by the cutter guard and generally ranges from about 4 to 4.5 inches (100–112 mm) for a nominally 4.5 inch (112 mm) angle grinder. The first prototype was made by spinning a heated disk of mild steel on a lathe. Other methods of forming a metal cutter include stamping and shaping from sheet stock, or using laser-cutting techniques (particular for hole cutting), then pressing in a die. A cutter of a plastics material may be made by the usual techniques Such as injection moulding and optionally these techniques include a fibrous base or core about which a matrix is added. In the event of a cutter having a thickness of much less than 3 mi., the blade thickness may need to be enhanced, by rolling or the like, to provide a more substantial bed for attaching the carbide insert. Since the working surface is provided by an annular attachment, provided that the disk is capable of retaining the annular attachment under cutting or abrading conditions, there are no inherent limitations on the materials that may be used to form the disk. Practically speaking however it is often preferred to use steel.

Disk Holes

Perforations in the disk are provided in part so that the user can see the material to be cut or abraded through the spinning disk as the tool working zone is drawn towards the user. For convenience the perforations are circular or at least have no sharp or narrow corners because of the risk of propagation of cracks from stressed areas. Holes 24 mm in diameter have been suitable. The holes are preferably equidistant from the centre but this arrangement is not essential. Hole positions are preferably selected so as to retain the balance of the disk, and disks may be balanced dynamically by removing material from hole edges. The perforations may also aid in stirring the air so that any swarf is carried by the moving air and is ejected further or more effectively. For moving air the holes may be racked (drilled obliquely) or pitched. They may also be used as clamping points for a jig for alignment of the cutter in automated sharpening operations.

Holes are a preferred option for the disks of the invention; providing visibility of the work about to be cut or abraded, and aiding (especially if raked) in stirring and moving the air. The preferred embodiment has three equally spaced holes. Other combinations which place various holes at different distances from the centre may be used, although it is always preferable to maintain static and dynamic balance in rapidly rotating disks.

Mounting Means

We have provided a central threaded aperture in our prototypes. Generally a spacer or thrust washer of approximately 10 mm thickness is used about the arbor or spindle of the angle grinder, beneath the concave face of the disk, so that its spring edges clear the guard of the angle grinder; although a suitably pressed cutter having a depressed mounting hole may not require the use of a spacer. Conveniently the threaded cutter prototypes do not bind onto the angle grinder during use.

DRAWINGS

Figure 1B:
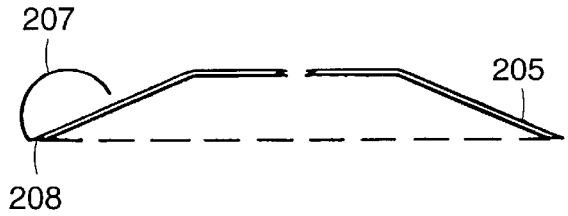
Figure 1C:
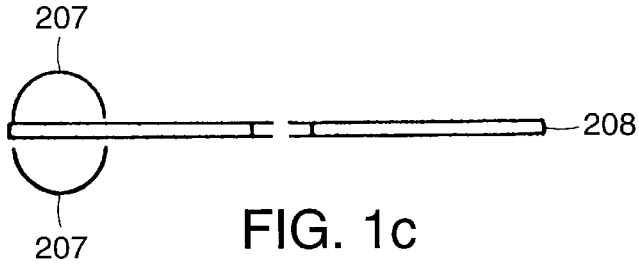

The following is a description of a preferred form of the invention, given by way of example FIG. 1: shows three general optional profiles for the basic tool member useful in the present invention.

Figure 2B:
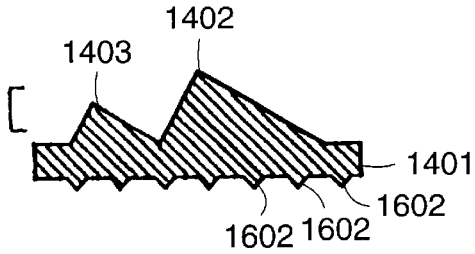
Figure 2A:
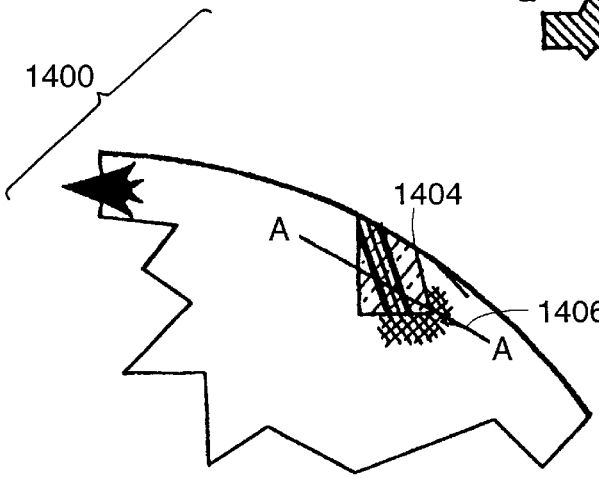

FIG. 2: shows a portion of an annular attachment for the basic tool showing the location and orientation of teeth on the attachment.

Figure 3A:
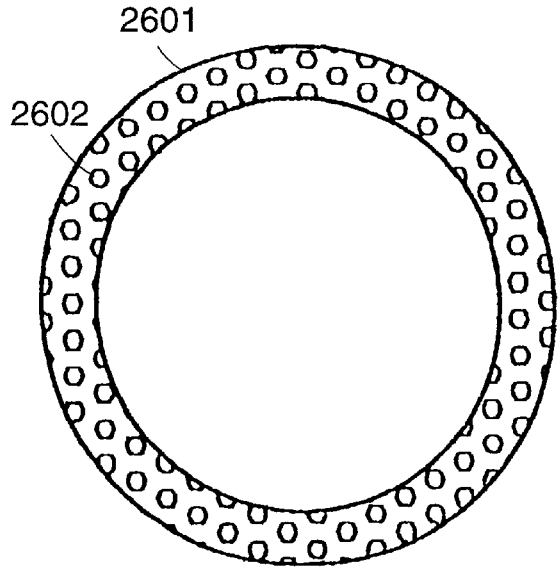
Figure 3B:
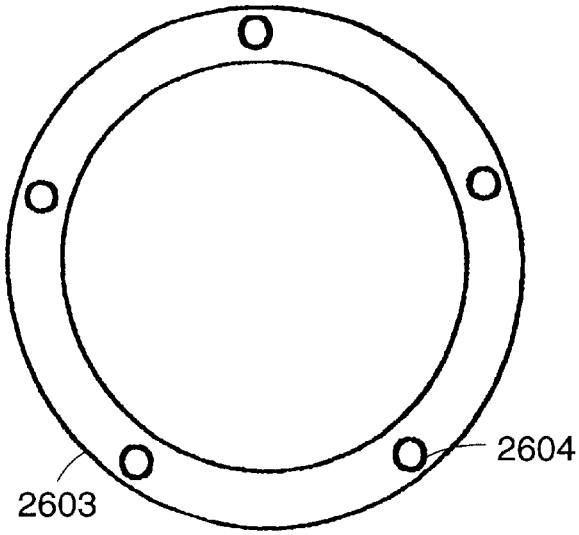
Figure 3C:
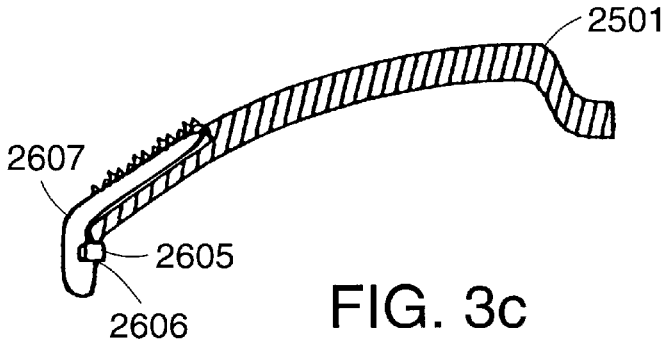

FIG. 3: shows a tool according to the invention with an annular attachment in place. In this case the working surface is provided by a hard abrasive material bonded to the surface of the annular attachment.

Figure 4:
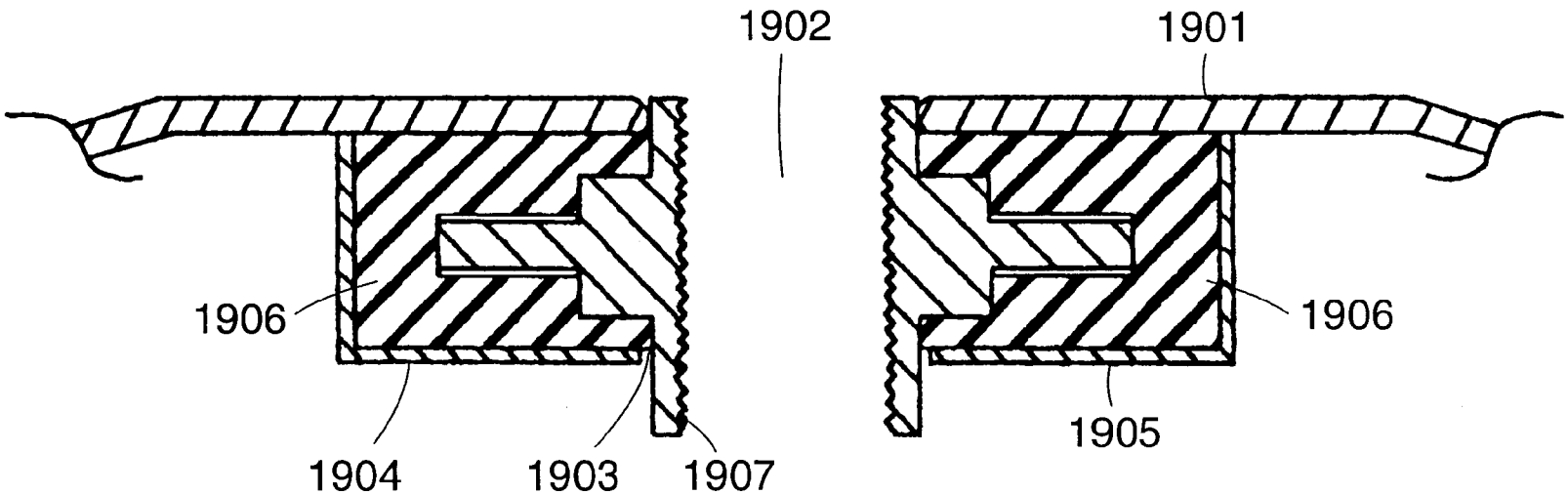

FIG. 4: shows a type of resilient central mount for a tool according to the invention.

Figure 5B:
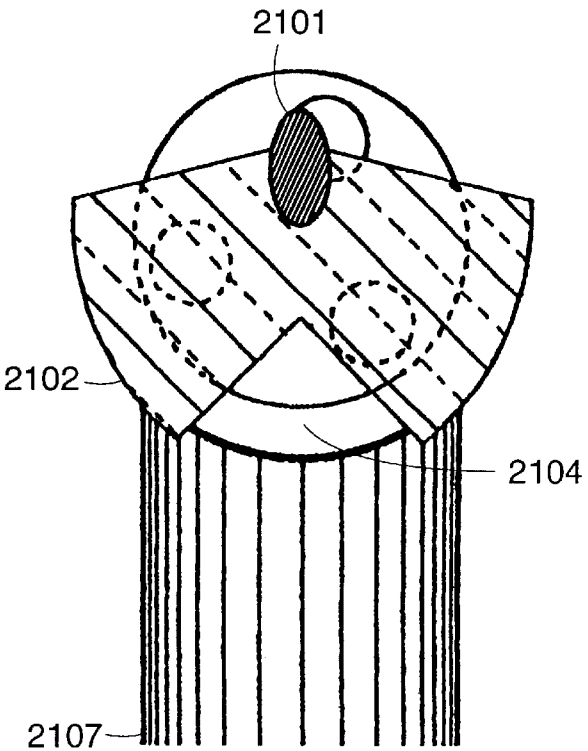
Figure 5C:
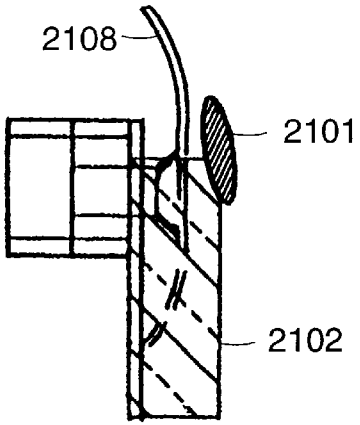
Figure 5A:
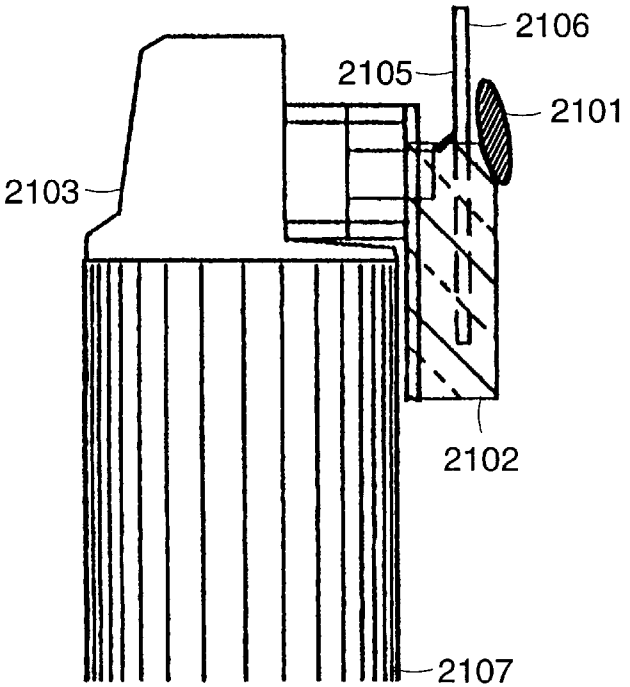
Figure 6A:
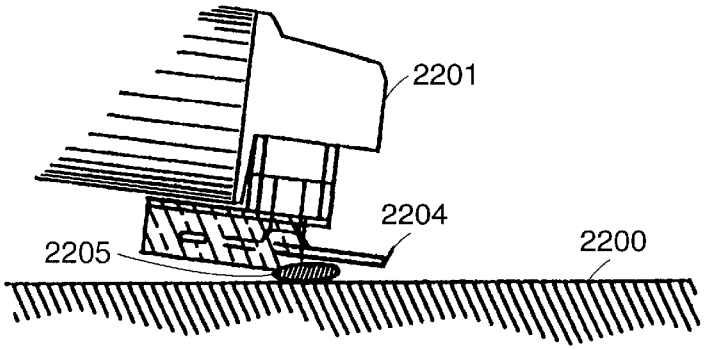
Figure 6D:
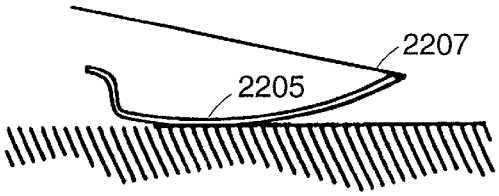
Figure 6B:
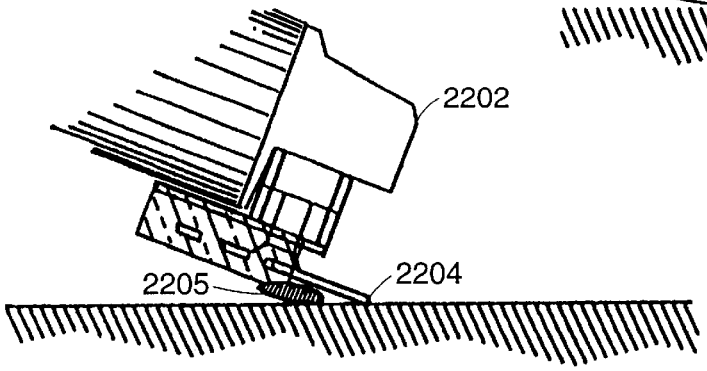
Figure 6E:
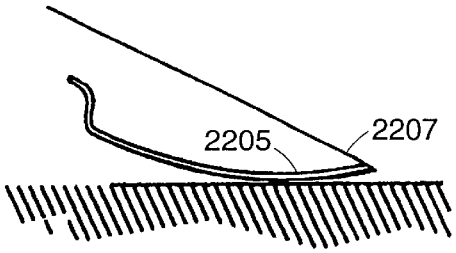
Figure 6C:
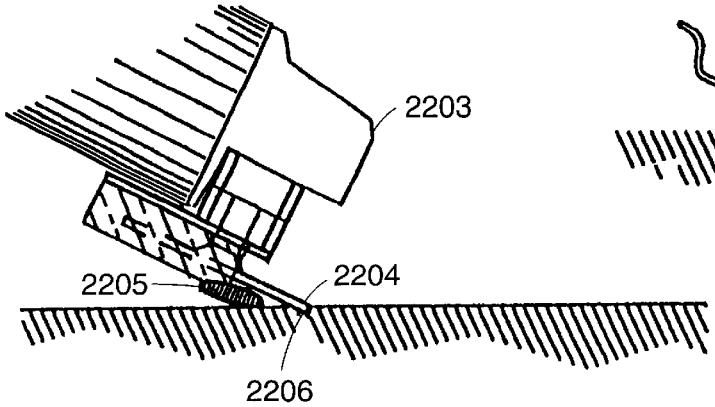
Figure 6F:
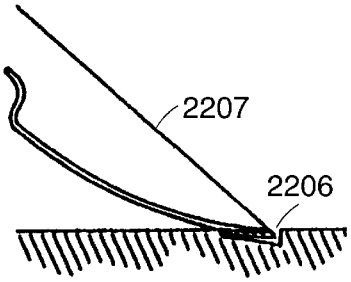

FIG. 5: shows a type of guard for a grinder system, including a central mound or protrusion capable of being used as a rest point, permitting better control of the tool. This type of system is particularly useful where the tool is flat.

FIG. 6: shows the method of use when an angle grinder incorporating a tool according to the invention is used. The tool is inclined about the rest point in order to engage, or further engage, the active contact zone with some work material.

Figure 7:
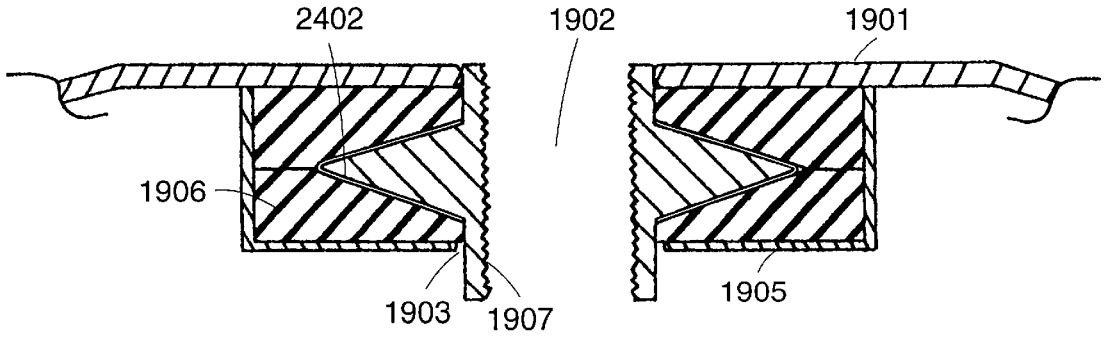

FIG. 7: shows an alternative clutch and central resilient mount for a disk.

Figure 8:
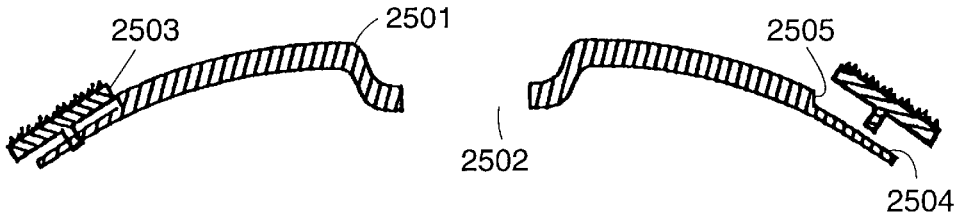

FIG. 8: shows the basic tool in section, with annular attachments.

Figure 9:
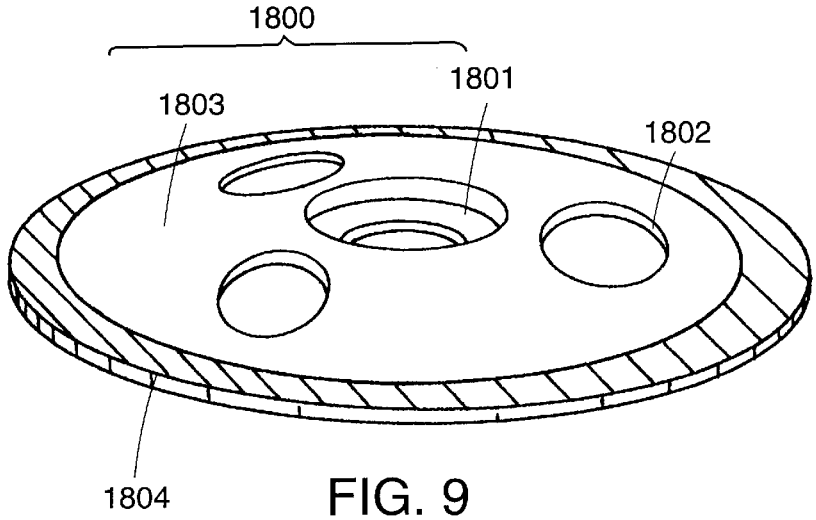
Figure 10A:
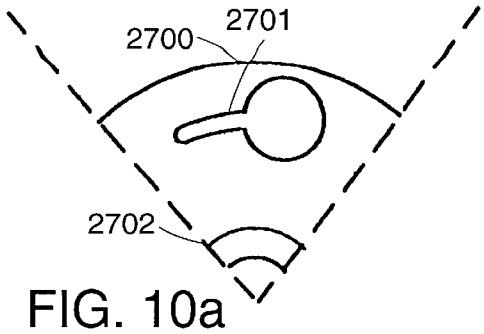
Figure 10D:
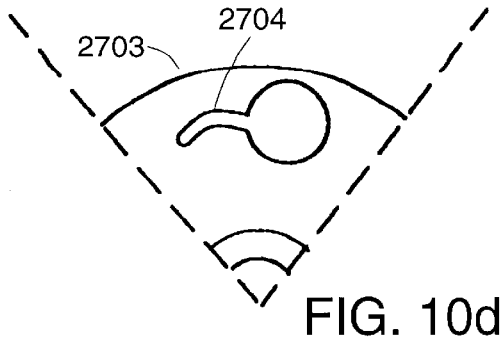
Figure 10B:
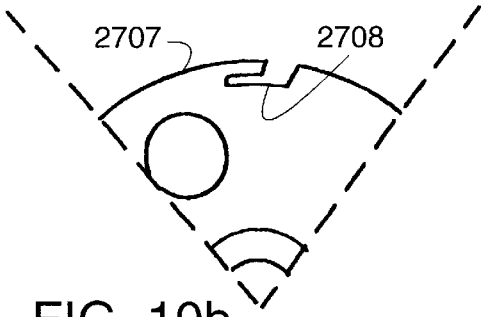
Figure 10E:
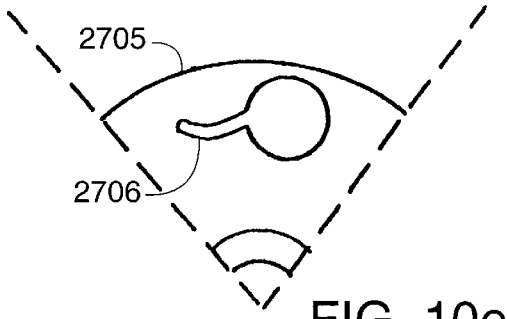
Figure 10C:
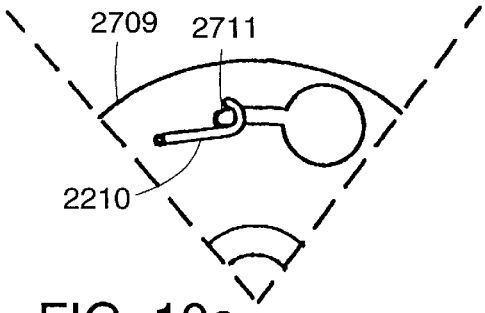
Figure 10F:
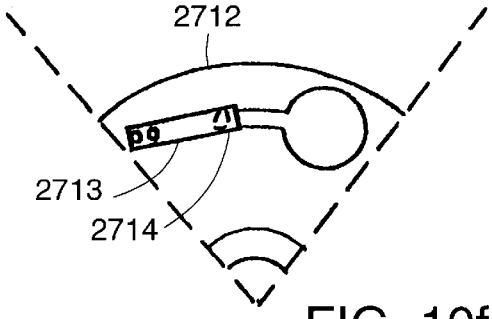
Figure 10G:
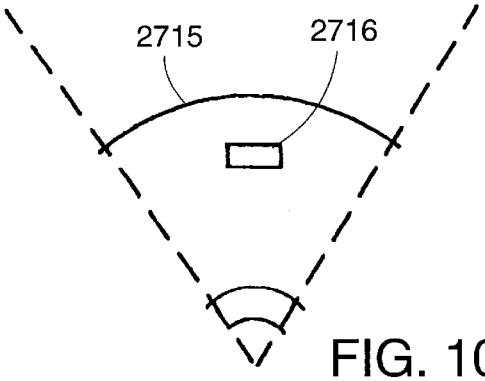

FIG. 9: shows an annular attachment.

FIG. 10: shows a variety of tool bases with various means for attaching the annular attachments.

Figure 11A:
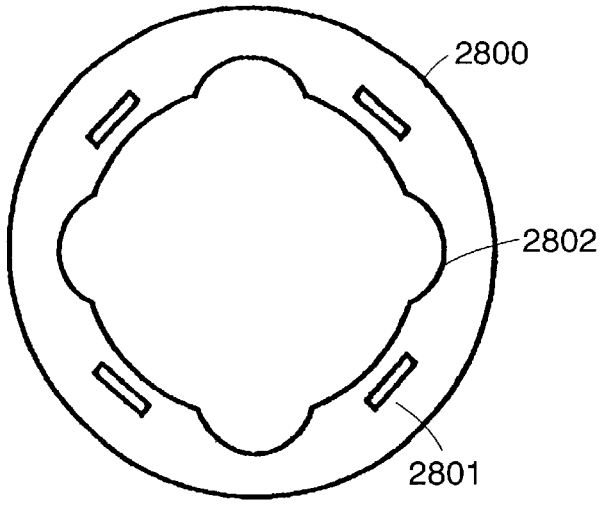
Figure 11B:
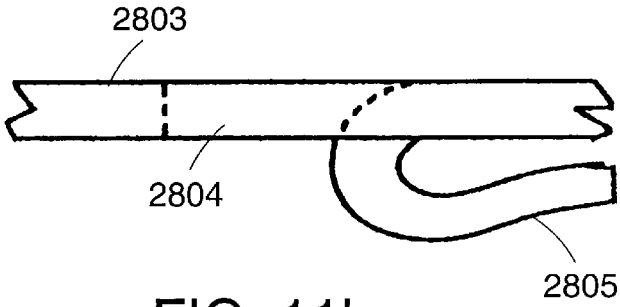
Figure 11C:
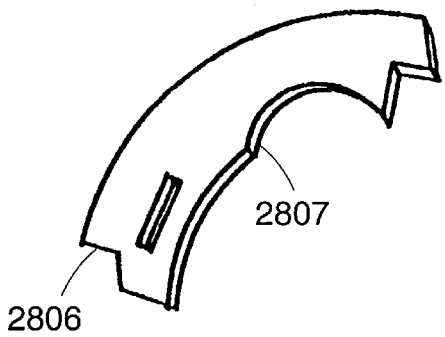

FIG. 11: shows another method for attaching an annular attachment.

PREFERRED EMBODIMENTS

The invention is now described with particular reference to the Drawings attached hereto which are for the purpose of illustration only are imply no necessary limitation on the essential scope of the invention.

In the Drawings, FIG. 1 shows a variety of shapes of the rotatable disk-shaped tool to which the annular attachment may be fitted. FIGS. 2, 3, 8 and 9 show alternative forms of the annular attachment and the cutting or abrading surface carried thereon. FIGS. 10 and 11 show alternative ways of securing the annular attachment to the disk-shaped tool. FIG. 5 shows an alternative form of rest means. FIGS. 4 and 7 show alternative ways of mounting the disk shaped tool to an angle grinder and FIG. 6 shows the way in which the tool is used in practice.

In more detail, the preferred tool comprises an optionally perforated metal disk capable of attachment to the angle grinder shaft. Preferred disks are convex, like the saucer for a cup but flat disks can also be used. Suitable disks are illustrated in cross-section in three different embodiments in FIG. 1 with the annular attachment omitted for clarity. In the drawing, the rest means in the top embodiment is provided by the area indicated as 101. In each case a central mounting aperture 202 is provided. In the top embodiment there is a recessed area surrounding the aperture. The working zone over which the annular attachment is affixed is indicated at 207 and the outer peripheral edge is indicated at 208. The lowest embodiment is a flat disk that can optionally have two working zones each with an attached annular attachment. This allows the disk to be flipped over to provide longer life for the disk or alternatively different types of cutting and/or abrading oil the opposite sides of the disk.

Referring now to the embodiments illustrated in FIG. 8, which emplys a disk-shaped tool with a convex surface, the outer perimeter of the rotatable disk-shaped tool surface is adapted to support an annular attachment bearing a cutting or abrading surface. The more central part of the tool retains a rest means or protrusion (2500). The annular attachment may be cheap and disposable, and can be fabricated with any of a wide range of cutting or abrading surfaces, the surface being engageable with the work surface as the tool, while resting on its rest means is tilted so that the cutting or abrasive portion is brought controllably into contact with the work. The disk or tool base itself is shown in section in FIG. 8, with an annular tool (2503) attached and lifted above a groove at 2504. The material of the disk providing the tool base may be mild steel or the like and, in one embodiment, has a thicker inner part and a thinner outer part over which the tools may be placed and located by means of a press fit against the ridge 2505. The disk has a curved profile providing the user with a fulcrum (2501) in a rest means against which the angle grinder may be rocked in order to progressively engage the working surfaces against the work.

FIG. 3 shows an annular attachable tool 2601 in outer or working surface view 2602 (with a coarse grit) and 2603 shows a rear view of the same tool with mounting studs 2604.

FIG. 9 illustrates a further modification to the range of disks with annular attachments for an angle grinder. In this example the usual cup-shaped disk 1800 has a central mounting aperture 1801 and viewing holes 1802 (optionally the holes may be provided with cutting edges). The disk is provided with an annular attachment having an abrasive surface 1804. Typically this may be 1–2 mm tungsten grit, or cobalt high-speed steel grit, embedded in a matrix capable of holding the grit oil the wheel periphery during use.

Optionally a flat wheel having a similar annular attachment with an abrasive surface nut. This modification provides a type of sanding wheel, but unlike previously available cutoff disks and the like for angle grinders, the force with which the abrading surface is applied to the work may be varied by (a) providing a non-cutting portion of the disc (at about 1803) for rubbing against the work and then (b) varying the angle of the entire tool so that the abrading portion is controllably brought against the work. A steeper angle results in more aggressive abrasion.

FIG. 2 shows a portion of an annular attachment 1400 having (at least in part) a broaching action. In this type the annular attachment is provided with broaching teeth located in spaced arrangement around the periphery of the attachment in groups of two. One tooth uses the other as a kind of "sole" as for a conventional broaching tool. Possibly during cutting the first tooth 1403 raises the material to be cut away and the following higher tooth 1402 cuts it. This effect appears to occur in shaping fibreglass. It has been found that this type of blade is particularly suited to cutting hard material like magnesium-aluminum alloy, silicon-aluminium alloy, brass, bronze, mild steel, for which it is suitable (for instance) for bevelling the edges of sheets, and possibly even being able to cut weld seams of stainless steel. It has the advantage that the swarf is not hot—sparks are not emitted—and one can touch the work surface after cutting. Furthermore, the swarf is kept behind the blade and away from the operator. An example tooth pair 1404 is shown in section (along the line A—A) at 1401. The tooth edge 1403 extends above the cutter surface by the height of the scale—about 20 thousandths of an inch, and the other tooth 1402 extends by a further 20 thousandths of an inch (0.51 mm). Another disk was made with the first tooth height 12/1000 inch (0.30 mm), the second tooth height 32/1000 inch (0.81 mm) and the tips projecting by 10 to 28/1000 inch (0.25 to 0.71 mm). The tooth edge is inclined at about 45 degrees to the radius. The grade of tungsten carbide insert is 883 (P25). The base of each insert may include a series of sculpted extensions as shown at 1602.

Attachment of the annular attachments to the disk may be accomplished by a variety of means, some of which are illustrated in FIGS. 9, 10, and 11. Clearly, if one is to provide demountable, disposable tools there is a need to provide secure attachment means, capable of withstanding normal use and also capable of holding on to the tool base even when pushed past normal working limits. In FIG. 10 which shows a variety of tool bases, a simple bayonet lock type of attachment is shown at 2701 extending from one of the (typically) four viewing holes provided within the tool base 2700. It is extended in the direction that an attachment experiencing torque would tend to turn. 2703 and 2705 shows developments of a bayonet lock including a cam arrangement to assist in positive locking. The cam of 2704 is inclined peripherally, and that of 2706 is inclined centrally. The tool base 2707 has a bayonet cut in from an edge. The tool base 2709 has a hinged catch 2710 to engage with a projecting stud coming through a bayonet slot. Centrifugal force will tend to close this catch. The tool base 2712 has a spring-mounted catch 2713 to engage with a stud 2714. This appears to be one of the more secure attachment means. A further means is shown in FIG. 28; this one compatible with pressed-steel attachments. An attachment 2800 includes a number of slots 2801; the material from each slot is bent around as shown in section at 2803, where the pressed material forms a bent tongue 2805 projecting to one side of the slot 2804. Spring pressure exerted by that bent tongue assists in holding the attachment onto the tool base—the preferred base is like that of 2715, carrying slots 2716. A pressed steel attachment 2806 may be provided with cutting edges as shown at 2807.

Another attachment system is known as the "circlip" system, also shown in FIG. 9. In this case the tool or attachment includes a portion brought over the edge or lip of the tool base and with dimensions such that it is more or less a press fit. An apron 2607 reaches around the tool base and terminates in an inward-facing groove 2606. A circlip 2605 may be clipped into this groove so as to enclose the edges of the tool base, in order to hold the tool in place. Conventional circlip pliers may be used to open the circlip for removal. In addition, the edge of the tool base may be formed so as to match indentations in the apron in order to minimise spinning of the attached tool on the tool base. This particular system is compatible with plastics forming processes and gives a reasonably secure attachment for the tool.

Annular attachments may be formed of metal or plastics materials, in the shape of a truncated cone, bearing on its inner face some means for attachment to the tool base and bearing on its outer face some kind of cutting or abrading formation. Examples include: a tool having a relatively small number of cutting teeth, a layer of abrasive grains, a tool having a wire brush surface, a tool comprised of a relatively soft matrix (copper or rubber) in which diamond grit is embedded, or an attachment may be entirely comprised of an "active" material—a grindstone or the like. The attachments may be rigid or flexible. They may be only sufficiently flexible to have enough "give" to permit secure attachment to the tool base, or they may have flexibility intended to function during use, such as the flexing of wire bristles.

All these attachments are maintained in a reasonably concentric relationship with the arbor of the angle grinder by abutment with the ridge 2505 of FIG. 8—although possibly, with suitably designed attachment devices (or a sufficient number of them) the ridge is not necessary.

The provision of a rest means is a key element of the present invention. Where the disk shaped tool has a convex shape, rest means is provided by the portion of the disk radially inside the working zone and adjacent the axis. However flat-bladed disks with annular attachments can also be produced according to this invention. In order to provide a rest means rubbing surface for use with such a flat disk, a kind of dome nut can be used as part of the attachment of the disk to the grinder drive shaft. The head of this dome nut is held in rubbing or sliding contact with the work, and the cutter is tilted so that the teeth dig in at a suitable rate. The dome nut may be shaped more like a mushroom, but then the increased radial velocity of the surface in contact leads to increased friction, wear, and reaction forces.

Optionally, a separately mounted domed spacer may be used. This can be, at least in part, rotationally mounted—for example, on a ball-bearing—so that it may come to rest rather than rub on the surface of the work, and provide a rest means as a non-rubbing surface without friction. In the case of some plastics (for example), the friction generated by sliding at the rubbing surface (especially at the rates of revolution typical of angle grinders) may cause local burning, melting, difficulty of control, and damage to the surface. This improvement overcomes that problem.

A further type of rest means is provided on the actual angle grinder itself—not on its cutter. FIG. 5 illustrates a hard "nose" 2101 of for example hardened steel, chromium alloy, or for some applications a low-friction nose of PTFE plastic (polytetrafluorethane or "Teflon™" which is attached to the centre of a partial guard 2102 attached beneath the cutter of an angle grinder 2103. The beneath view B depicts an aperture 2104 which is intended for the ejection of waste material—swarf and the like. The side view A shows a flat disk type of cutter 2105 which is provided with cutting teeth (or like means) presented to the edge 2106. It will be evident that if the nose 2101 is rested on work material, and the body of the angle grinder 2107 is tilted so that the "active" edge 2106 of the cutter comes into contact with the work, an operator has a far better degree of control over rate and depth of cutting than if lie or she has no "nose" or rest means and has to set the active edge in the correct position solely by hand positioning.

The guard 2102 may be provided with a hinge and catch mechanism (not shown) so that it can flip open to allow the cutter to be cleaned or changed. Part C of this drawing shows a cutter blade 2108 having a dished profile and the adjacent nose 2101 and guard 2102. This presents a more nearly parallel alignment of tooth edges to a sheet of work material and is for example more suited to hand planing. This modification to provide a grinder system having rest means is not incompatible with the extra guard 1705 offered in FIG. 17 for the upper surface of the cutter disk.

When using an angle grinder with a tool according to this invention, the preferred movement is to drag the tool towards the user, or stroke it over the work material, while the working zone engages the material. The preferred apertures allow the user to see, through the disk, the site where the tool is about to cut or abrade. There is relatively little or no "kick" from the tool (not often the case with ordinary angle grinder tools or saw-like modifications,), and it is easy to hold and control the machine during operation in order to carry out relatively fine movements.

The angle made by the handle of the angle grinder to the work is typically about 30 degrees. (varied by the user from about 15 degrees to about 40 degrees) using the example cutter, but this depends on the shape to be formed. The angle allows the effective tooth protrusion amount to be varied. FIG. 6 illustrates this method, in which the rest means is a nose (left side series) or a rubbing surface. At the left are three variations (2201, 2202 and 2203) of tilt (respective to a work surface 2200) of an angle grinder with a nose 2205 and a flat disk cutter 2204; wherein the grinder system is being tilted on its nose 2205 so that the rotating disk 2204 approaches the work. In the centre left drawing the disk is just contacting the work. In the lowest left drawing it has eaten into the work at 2206 and swarf (not shown) is being ejected. At the right of FIG. 22 is shown three angles of tilt of a convex tool with an annular cutter blade attachment 2207, where the rubbing surface 2205 (which in this example is a part of the actual blade) moves towards the periphery until in the lowest drawing the blade is cutting into the work surface at 2206. Under full working load the cutter has a rotation speed of 8,000 rpm, which approximates, for a 3-tooth blade, 400 cuttings per second, or 24,000 cuttings per minute. The operator uses the sound of the loaded motor as a guide in adjusting the speed of cutting.

A further preferred feature is the provision of mounting means that reduce vibration and permit disengagement when torquelevels exceed a pre-determined amount.

FIG. 4 shows at 1900 a resilient central mount for a wheel 1901, having among other purposes the objective of minimising the effect of wheel imbalance on tool vibration. In FIG. 4, the resilient material (which is illustrated as 1906) is contained within a housing 1904 attached to the wheel, while a central threaded collar 1907 surrounding an aperture 1902 is attached to a fin 1905 running deeply into the resilient material, which is generally a type of rubber. There is a small gap at the base to allow wobble between the housing and the thread at 1903. Optionally the small gap may be at the outside, and the inner gap may be an interference fit. Optionally there may be a further layer of metal, between (and attached to) the resilient material and the fin 1905, to which it is not attached apart from a frictional grip, thereby providing a clutch so that if the torque exceeds a threshold, the fin 1905 may slip inside the further layer of metal. The base of the threaded collar (by 1907) serves as a nut to lock the wheel onto the arbor of the grinder.

FIG. 7 shows at 2400 an alternative clutch and central resilient mount to that of FIG. 4 for use with a tool base or disk. The clutch is designed to allow slippage when the torque applied to the tool is greater than a preset amount. It may include a "chatterbox" of some type to give an audible indication of slippage, and one way of providing this is to place several ball bearings 2402 between the disk and the resilient mount so that the balls click into or out recesses if the clutch slips. In this example the portion of the resilient mount threaded onto the arbor of the angle grinder has a cone-shaped projection (as seen in section 2401) into the resilient material.

ADVANTAGES

Advantages of Preferred Forms of this Invention Include

1. Material is usually removed in the form of individual large shavings or scrapings rather than as a dust;
2. The tool operates upon a wide variety of materials ranging from steel and aluminium to even wet timber and partially cured automotive body filler. (Optimised tungsten carbide inserts may vary for a wide range of materials). Material such as partially cured or cured automotive type body-filler material or solid aluminium can be sculpted, while soft materials such as lead or linoleum which would rapidly clog an abrasive are also quickly cut;
3. Material is removed quickly—removal speed is about 4–5 times quicker than for a router or planer, and about 15–20 times quicker than for a sanding disk—other factors being equal.
4. There is little reaction or kickback against the cutter edge, reducing stresses on operators, and minimising the risk of exhaustion and errors which may be expensive and/or dangerous;
5. Control of the results is excellent, achieved by tilting (to vary the bite) and moving the tool over the work surface, while experiencing little kickback.
6. The user can see through perforations in the spinning disk to accurately produce a desired conformation, or shape;
7. Unlike abrasive wheels conventionally used with angle grinders the lard cutting edges are of controlled form and dimensions and the cutting edges do not substantially change shape during use, unlike the shape of many abrasive wheels;
8. The tool can be resharpened once the teeth have become dulled (although slightly dulled teeth give a better finish on many materials);
9. The material of the disk need not be high-quality steel as is the case for circular saw blades, for example.
10. The work applied to the tool (ie. the power consumption of the grinder) is usually low enough to enable a rechargeable battery-operated grinder to be used.
11. The general approach of the invention is compatible with use of a resilient tool base onto which many kinds of cutting or abrasive tools can be affixed.

Finally, it will be appreciated that various alterations and modifications may be made to the shape of the disk, the teeth, the materials used in constructions, without departing from the scope of this invention as set forth.

What is claimed is:

1. An accessory for a grinder comprising a rotatable disk-shaped tool having a working zone (207) located around the outer perimeter of the disk, characterized in that the accessory further comprises a rest means (101, 2101, 2500) and an annular attachment (1804, 2503) coaxial with the disk and having a shaping surface, said attachment being releasably attached to the tool in the working zone thereof.

2. An accessory for a grinder according to claim 1 in which the disk has a convex surface.

3. An accessory for a grinder according to claim 1 in which the shaping surface of the annular attachment is provided with at least one cutting tooth (1402).

4. An accessory for a grinder according to claim 1 in which the shaping surface of the annular attachment is provided with from 3 to 24 teeth in symmetrical spaced arrangement around the annulus.

5. An accessory for a grinder according to claim 1 in which the shaping surface of the annular attachment is provided with abrading means selected from the group consisting of stubby projections, hard abrasive particles dispersed in a matrix, ribs, knurls and bristles.

6. An accessory for a grinder according to claim 5 in which the abrading means is located in spaced locations around the annular attachment.

7. An accessory for a grinder according to claim 1 in which the rest means (2101) is mounted independently of the rotatable disk-shaped tool while being located so as to permit the accessory to be supported on the rest means resting on a surface of a workpiece without substantial contact between the shaping surface and the workpiece while permitting rocking movement about the rest means to cause such contact.

8. An accessory for a grinder according to claim 2 in which the rest means is the portion of the convex surface of the disk-shaped tool (2205) located radially inward of the working zone.

9. An accessory for a grinder according to claim 1 in which the disk has at least one perforation (1802) located at least partially radially inward of the working zone.

10. An accessory for a grinder according to claim 9 in which the disk has at least three perforations in a symmetrical spaced relationship around the disk such that, when rotated at abrading speeds, a view of the vicinity of the surface abraded is obtained.

11. An annular disk (2503, 2601) characterized in that the disk is provided with a working surface (2602) and an attachment surface (2603) in which the working surface is provided with shaping means and the attachment surface is provided with means for reversible attachment of the annular disk to the peripheral portion of a rotatable disk substrate.

12. An annular disk according to claim 11 in which the shaping means is selected from the group consisting of teeth, hardened stubby projections, abrasive grits bonded to the working surface and wire bristles.

13. An annular disk according to claim 12 in which the shaping means are provided at spaced intervals around the working surface separated by rubbing surfaces.

14. An annular disk according to claim 12 in which the shaping means cover essentially all the working surface.

15. An annular disk according to claim 12 in which the shaping means are provided by hardened stubby projections.

16. An annular disk according to claim 15 in which hardened stubby projections are provided over substantially all parts of the working surface.

17. An annular disk according to claim 12 in which the shaping means are provided by abrasive grits bonded to the working surface.

18. An annular disc provided with a working surface and an attachment surface in which the working surface is provided with from 3 to 24 shaping means selected from the group consisting of teeth, hardened stubby projections, abrasive grits bonded to the working surface and wire bristles at spaced intervals around the working surface, said shaping means being separated by rubbing surfaces and the attachment surface is provided with means for reversible attachment of the annular disc to the peripheral portion of a rotatable disk substrate.

19. An annular disc provided with a working surface and an attachment surface in which the working surface is provided with shaping means comprising teeth in groups of from one to three and located at spaced intervals around the working surface and the attachment surface is provided with means for reversible attachment of the annular disc to the peripheral portion of a rotatable disk substrate.

20. An annular disk according to claim 19 in which there are from three to six groups of teeth.

21. An annular disc provided with a working surface and an attachment surface and the attachment surface is provided with means for reversible attachment of the annular disc to the peripheral portion of a rotatable disk substrate in which the reversible attachment means are physical structures adapted to cooperate with interlocking structures on a substrate to secure reversible attachment.

22. An annular disk according to claim 21 in which the attachment means comprises a plurality of symmetrically located studs (2604).

* * * * *